US012697536B2

(12) United States Patent
Jertson et al.

(10) Patent No.: US 12,697,536 B2
(45) Date of Patent: Aug. 4, 2026

(54) SYSTEMS, METHODS, AND ARTICLES OF MANUFACTURE TO MEASURE AND RECOMMEND LIE ANGLE

(71) Applicant: KARSTEN MANUFACTURING CORPORATION, Phoenix, AZ (US)

(72) Inventors: Martin R. Jertson, Phoenix, AZ (US); Roger J. Cottam, New River, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 538 days.

(21) Appl. No.: 18/333,492

(22) Filed: Jun. 12, 2023

(65) Prior Publication Data

US 2024/0082680 A1 Mar. 14, 2024

Related U.S. Application Data

(60) Provisional application No. 63/351,306, filed on Jun. 10, 2022.

(51) Int. Cl.

| | |
|---|---|
| ***A63B 69/36*** | (2006.01) |
| ***A63B 60/46*** | (2015.01) |
| ***A63B 71/06*** | (2006.01) |

(52) U.S. Cl.

CPC ..... *A63B 69/3635* (2013.01); *A63B 60/46* (2015.10); *A63B 71/0622* (2013.01); *A63B 2220/16* (2013.01); *A63B 2220/40* (2013.01)

(58) Field of Classification Search

CPC . A63B 69/3635; A63B 60/46; A63B 71/0622; A63B 2220/16; A63B 2220/40; A63B 2071/0655; A63B 69/3685; A63B 69/3632

USPC ..... 473/131–413

See application file for complete search history.

(56) References Cited

U.S. PATENT DOCUMENTS

| | | | | |
|---|---|---|---|---|
| 5,911,636 | A | 6/1999 | Schmoll | |
| 6,779,277 | B2 | 8/2004 | Sones | |
| 6,871,414 | B2 | 3/2005 | Burney | |
| 7,250,005 | B2 | 7/2007 | Wood | |
| 7,311,611 | B2 | 12/2007 | Cameron | |
| 7,867,110 | B2 | 1/2011 | Edel | |
| 7,993,209 | B2 | 8/2011 | Kawai | |
| 8,371,962 | B2 * | 2/2013 | Solheim | A63B 24/0021 473/409 |
| 8,696,482 | B1 * | 4/2014 | Pedenko | A63B 24/0003 473/223 |
| 8,926,454 | B2 | 1/2015 | Solheim | |
| 8,998,717 | B2 * | 4/2015 | Parke | G06V 40/23 473/409 |
| 9,211,439 | B1 * | 12/2015 | Pedenko | A63B 69/36 |
| 9,339,707 | B2 * | 5/2016 | Jeffery | A63B 60/42 |
| 9,821,210 | B2 * | 11/2017 | Cottam | A63B 69/3658 |
| 10,137,347 | B2 | 11/2018 | Thornton | |
| 2006/0029916 | A1 | 2/2006 | Boscha | |

(Continued)

FOREIGN PATENT DOCUMENTS

| | | | | |
|---|---|---|---|---|
| JP | 2021058291 | A | 4/2021 | |
| KR | 20150134771 | A | 12/2015 | |
| WO | WO-2005093365 | A1 * | 10/2005 | A63B 53/005 |

*Primary Examiner* — Nini F Legesse

(57) ABSTRACT

Embodiments of a system for measuring and displaying a color code representing a lie angle value corresponding to suitably calibrated club heads are described herein.

14 Claims, 12 Drawing Sheets
(3 of 12 Drawing Sheet(s) Filed in Color)

(56) References Cited

U.S. PATENT DOCUMENTS

| | | | | |
|---|---|---|---|---|
| 2008/0076605 | A1* | 3/2008 | Horn | A63B 60/00 473/409 |
| 2008/0085778 | A1* | 4/2008 | Dugan | A63B 69/38 473/409 |
| 2011/0191204 | A1 | 8/2011 | Litke | |
| 2013/0165246 | A1* | 6/2013 | Jeffery | A63B 24/0062 473/409 |
| 2017/0004358 | A1* | 1/2017 | Bose | G06Q 10/0639 |
| 2017/0203153 | A1 | 7/2017 | Sato | |
| 2021/0187372 | A1 | 6/2021 | Stechschulte | |
| 2022/0203181 | A1 | 6/2022 | Ranford | |

* cited by examiner

SYSTEMS, METHODS, AND ARTICLES OF MANUFACTURE TO MEASURE AND RECOMMEND LIE ANGLE

CROSS REFERENCE PRIORITIES

This claims the benefit of U.S. Provisional Application No. 63/351,306, filed Jun. 10, 2022, all of which is incorporated herein by reference.

TECHNICAL FIELD

This disclosure relates generally to computing and tracking software for computer-implemented golf player analysis for club characteristic recommendations; and, more particularly, relates to a tracking and computing system that observes player position at address to recommend a color code for clubs with a suitably calibrated lie angle for that particular player.

BACKGROUND

In the sport of golf, golf clubs suiting a player-specific swing characteristics ensures each stroke results in a consistent, predictable interaction with the golf ball. Determination of player-specific swing characteristics has predominantly been achieved by use of motion sensors coupled to golf clubs that generate data throughout a player's golf swing, thereby allowing players to match their swings with golf clubs that will optimize their performance.

Technical problems persist. While dynamic motion sensors serve a purpose, they do not accurately determine the lie angle for specific clubs used to hit short-game golf shots. Golf clubs used for short-game golf shots, constituting putters or other suitable clubs, have a lie angle at address that closely mirrors the lie angle at the point of impact. Thus, matching a player's lie angle at address to the lie angle of a specific club gives the golf ball the best possible chance to striking the golf club near the center of gravity, ensuring a solid strike by reducing the likelihood of off-center contact. Golf club manufacturers can bend the hosel or neck portion of a putter or other suitable short-game club from a neutral position to a player-specific lie angle when they have accurate data regarding a player's lie angle at address. Existing methods of determining lie angle at address include analyzing still images or using physical tools to roughly estimate lie angle—methods that are time-consuming and potentially inaccurate because they rely on a subjective determination of when a player has reached a static address position. Instead of dynamic motion sensors and existing methods that cannot accurately predict a player's lie angle at address, there is a need in the art for an orientation detection system that evaluates at a static position. The system can thereby determine a player's lie angle at address when hitting short-game golf shots and assign the player a color code corresponding to a complementary lie angle of a specific club. Players may want this software to be compatible with already-owned and/or everyday-used portable electronic devices, allowing players or golf club fitting specialists to efficiently and accurately match golf clubs to the player's specific lie angle at address.

The optimum lie angle orientation is considered neither "toe-up" or "toe-down," such that both the heel and toe sit evenly above the ground plane, as shown in FIG. 2. These loft and lie configurations position the club head such that a well fitted short-game club will define a near 90-degree angle between a vertical face plane and ground plane, and a near 0 degree angle between the sole and the ground plane. Therefore, the sole of the club will be near parallel to the ground or strike surface. As illustrated in FIG. 3, if the toe is tilted too far up, the club head will produce shots that pull left. Conversely, if the toe is tilted too far down, the club head will produce shots that push right. A well fitted club with the correct lie angle for a given player will have a sole that is near parallel to the ground and produce shots straight off the face.

The lie angle is heavily dependent on the way a player prefers to hold the club. Additionally, the height of a player can affect the distance from the player's hands to the ground. This, in turn, will influence the degree to which a player will angle the club head in order to line up their address position. The system described herein takes the player's personal preference for form into the measurement when determining clubs with the best lie angle for a given player.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

To facilitate further description of the embodiments, the following drawings are provided in which.

Corresponding reference characters indicate corresponding elements among the view of the drawings. The headings used in the figures do not limit the scope of the claims.

DETAILED DESCRIPTION

Figure 1:
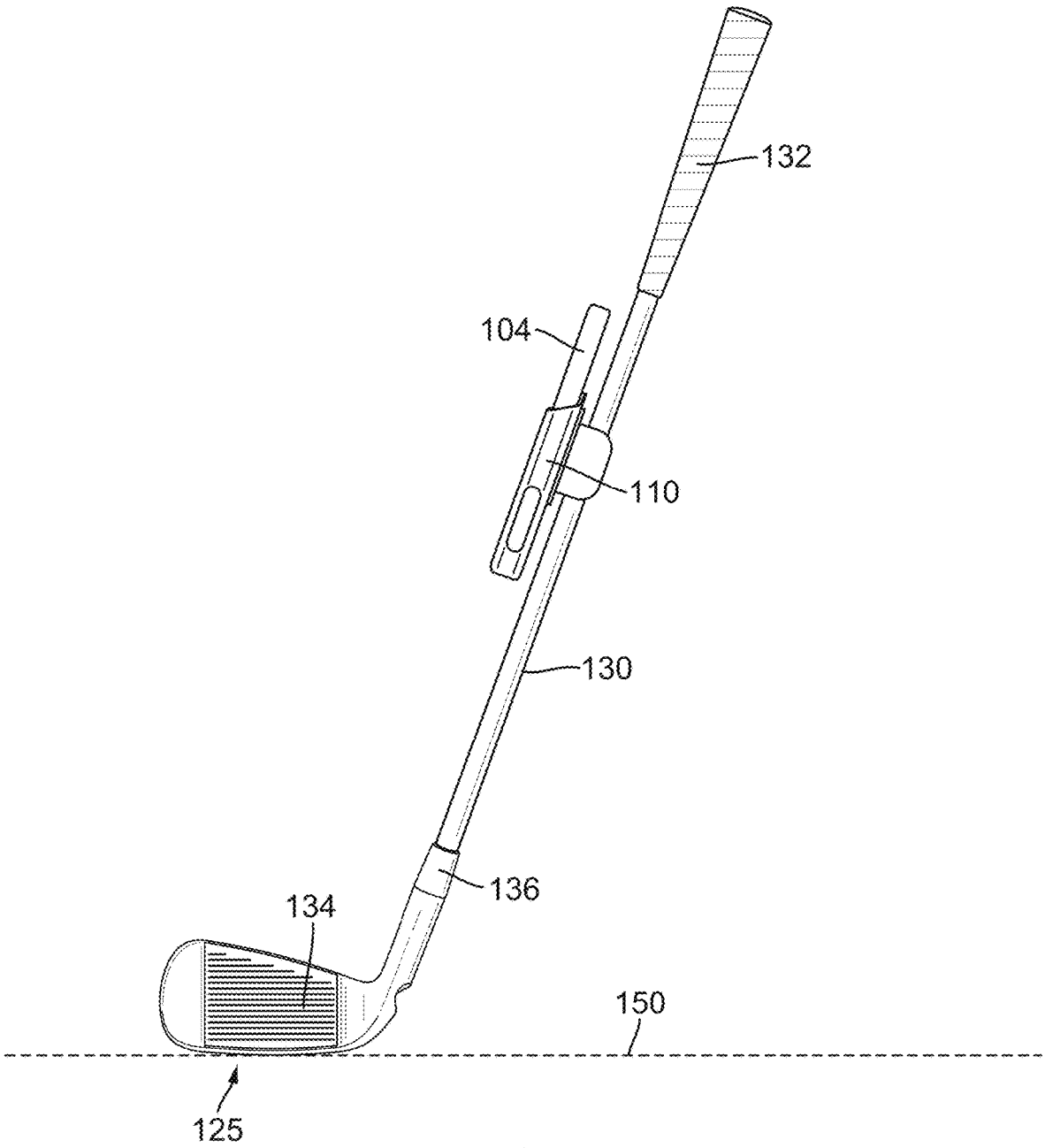
FIG. 1 illustrates a side view of one embodiment of a portable electronic monitoring device connected to a shaft of a golf club.
Figure 2:
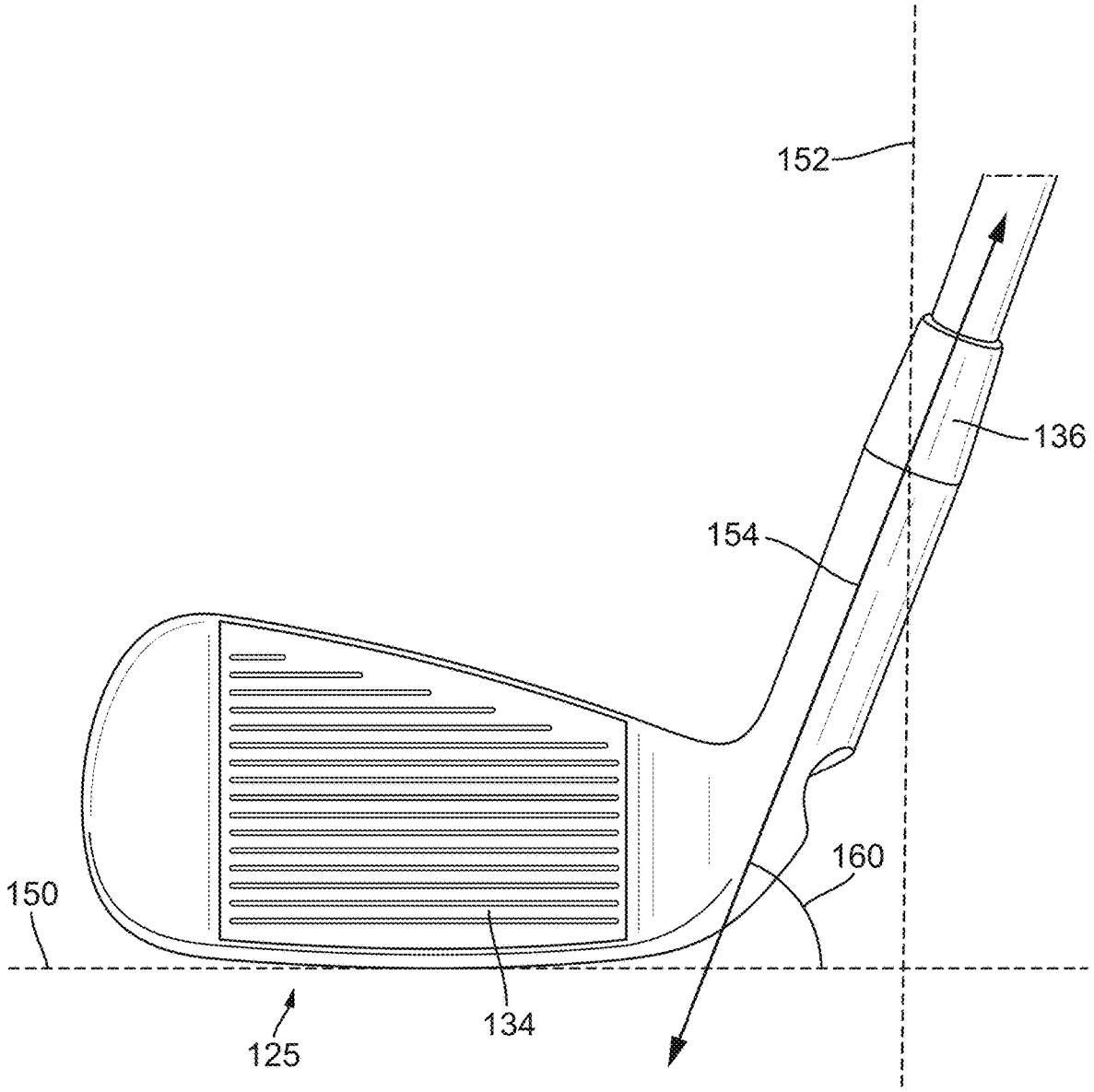
FIG. 2 illustrates a side view of the head of the golf club of FIG. 1.
Figure 3:
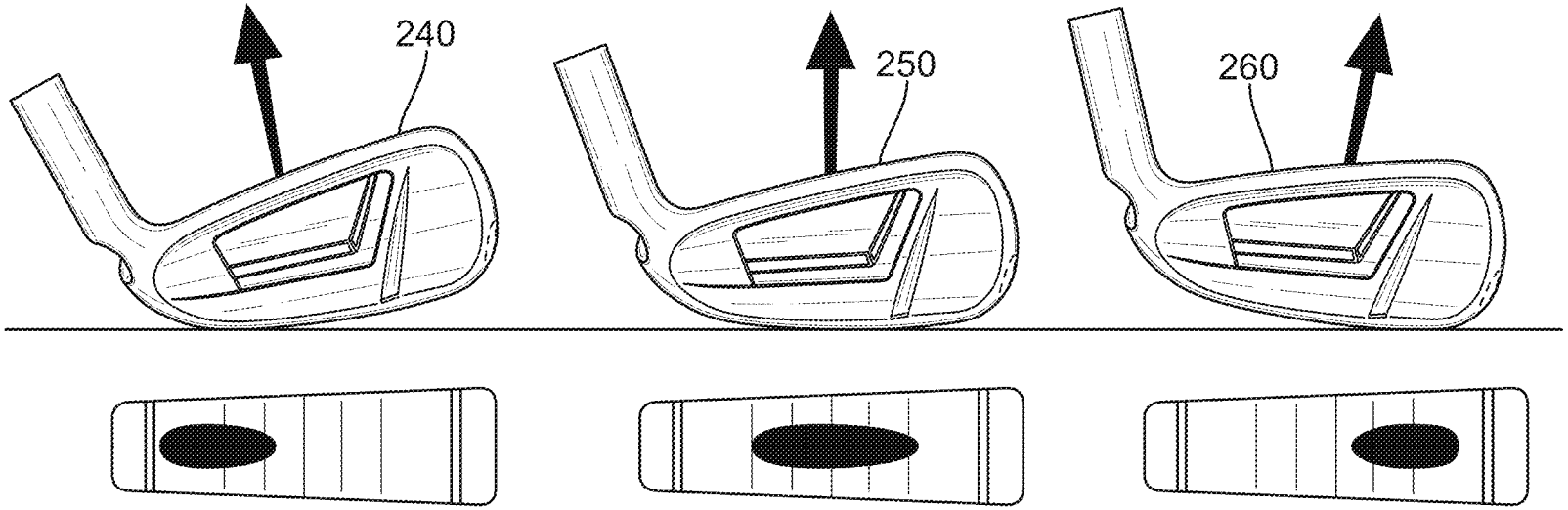
FIG. 3 illustrates the toe-up, parallel-to-ground, and toe-down striking positions of a golf club head, as well as their respective ground contact and launch characteristics.
Figure 4:
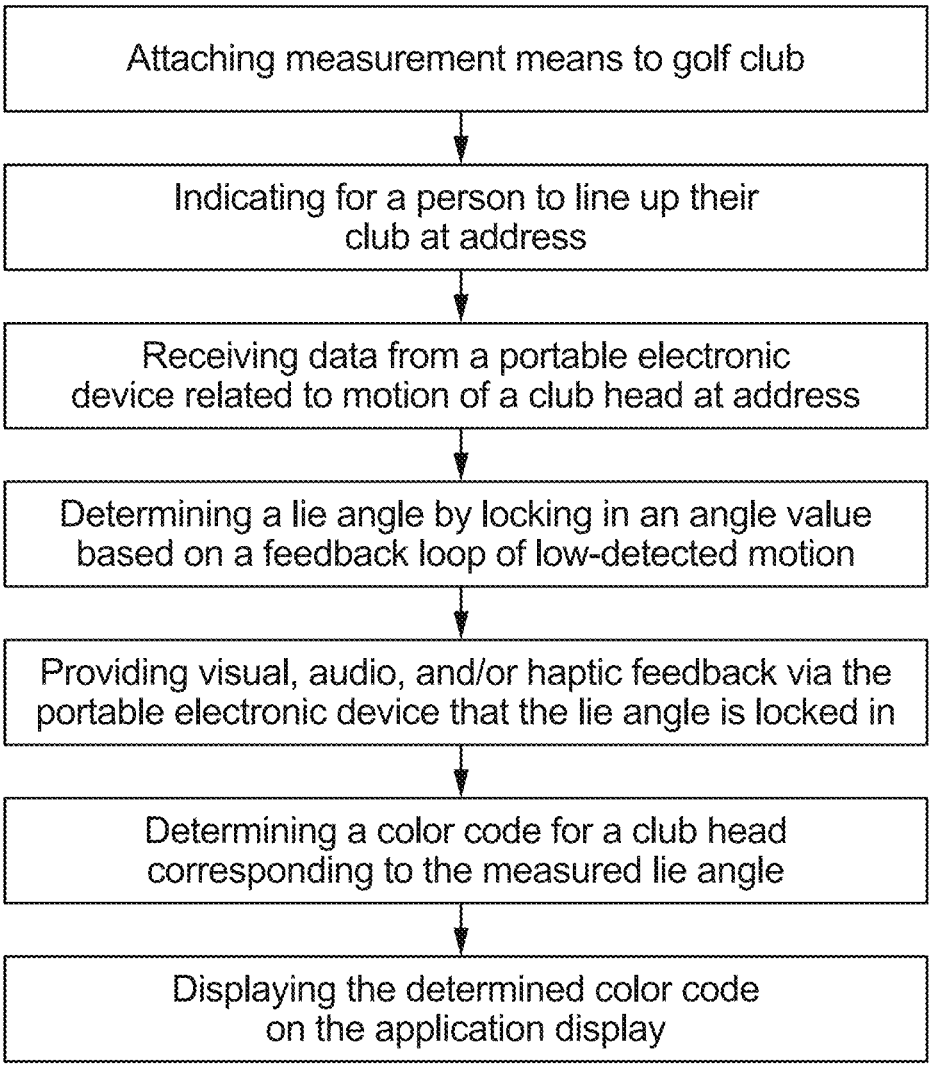
FIG. 4 is a block diagram illustrating a first representation of a non-limiting process associated with the systems, methods, and articles of manufacture according to the disclosure.
Figure 5:
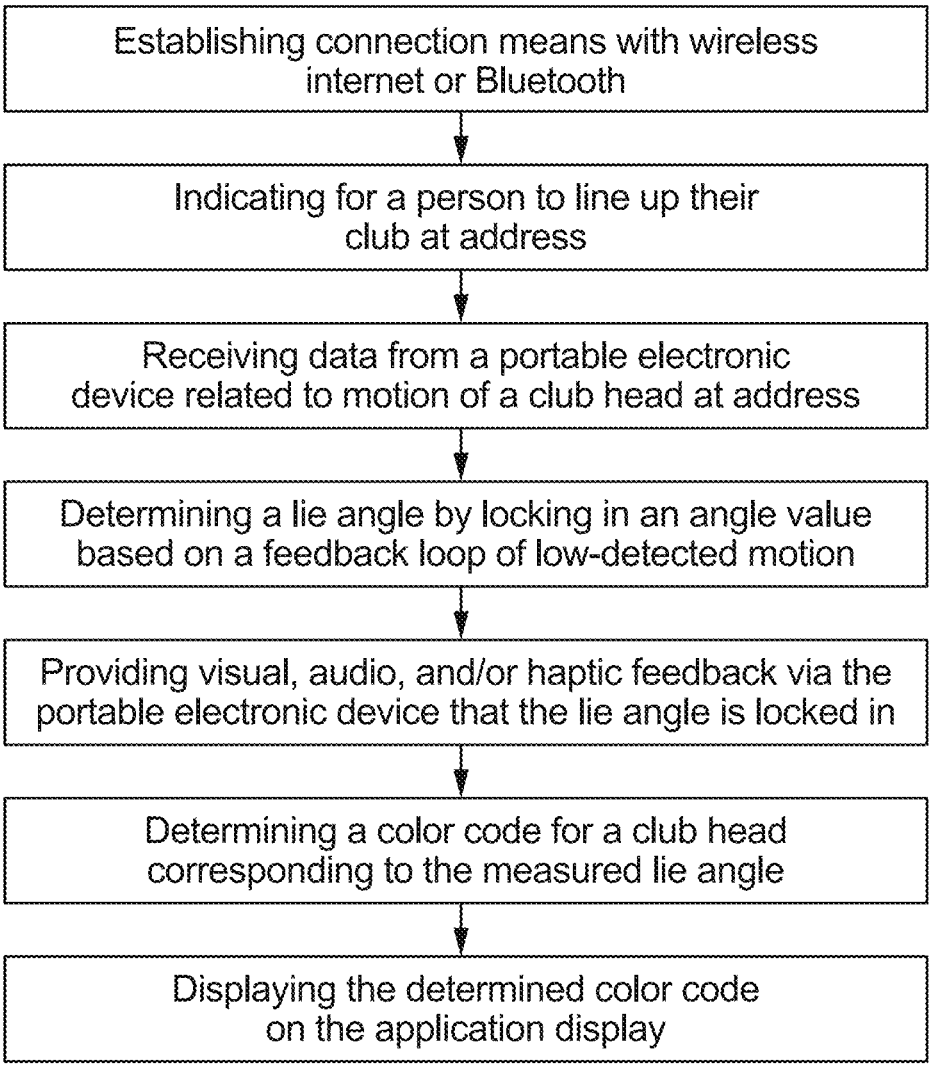
FIG. 5 is a block diagram illustrating a second representation of a non-limiting process associated with the systems, methods, and articles of manufacture according to the disclosure.

Described herein is a convenient and accurate system 100 that can assign a color code 200 to a corresponding lie angle

160 measured live from a player holding a club at address, among other features. The system 100 comprises at least one processor or processing element that is configured (via software or other machine-readable instructions) to utilize electrical components such as a gyroscope, accelerometer, and/or other suitable sensor components from at least one portable electronic device 104 and generate data that determines a player's golf club lie angle 160 at address. All golfers hold their club differently at address based on varying height, arm-to-ground length, grip, proximity to the ball, or a variety of other factors. This results in an inherent lie angle 160 for a given golfer. Golf club heads or shafts can be adjusted to accommodate that lie angle 160, ensuring the club head rests horizontally parallel to the ground plane 150 and that the center of the strike face 134 will impact the ball during a swing. A club head with a lie angle 160 misadjusted for a user can result in off-center hits near the toe, heel, or blade, depending on whether the lie angle 160 is too high or low. As such, the lie angle 160 is an important factor for proper club fitting and optimum play.

The system 100 further comprises a detection mechanism (implemented, e.g., as machine-readable instructions, code, or software) that the processor can execute to register when a player's lie angle 160 standard deviation drops below the upper limit of a sensitivity threshold, indicating that a player has reached their live address position 230, which then triggers a time-delayed locking mechanism. The locking mechanism can proceed to countdown, giving audio and visual feedback via the interface of a portable electronic device 104, and lock on a particular lie angle 160, so long as the lie angle 160 standard deviation does not exceed the sensitivity threshold's upper limit during the countdown interval. If the lie angle 160 standard deviation does exceed the sensitivity threshold's upper limit during the countdown interval, the processor as configured can retrigger the time-delayed locking mechanism when the lie angle 160 standard deviation drops back below the upper limit of the sensitivity threshold. When the processor successfully locks on a player's lie angle 160 at address, the processor can issue an instruction to display a specific color on the portable electronic device display 104, accompanied by an audible tone projected through the electronic device's speaker.

In a first illustrative example, the inventive concept of the present disclosure can take the form of a computer-implemented system including a processor and a plurality of electrical components in communication with the processor. In general, the processor is configured to issue an indication for a user to line up the golf club at address, data associated with the measurements from the plurality of sensor components related to motion of a head of the golf club at the address, and determine a lie angle by locking in an angle value based on a feedback loop of low-detected motion, the lie angle corresponding to a color code, the color code being predetermined to be associated with one or more golf clubs calibrated to the lie angle. In other illustrative examples, the inventive concept can take the form of a processor, computer-readable media, or the like configured to perform the operations above.

The foregoing examples broadly outline various aspects, features, and technical advantages of examples according to the disclosure in order that the detailed description that follows may be better understood. It is further appreciated that the above operations described in the context of the illustrative example method, device, and computer-readable medium are not required and that one or more operations may be excluded and/or other additional operations discussed herein may be included. Additional features and advantages will be described hereinafter. The conception and specific examples illustrated and described herein may be readily utilized as a basis for modifying or designing other structures for carrying out the same purposes of the present disclosure. Such equivalent constructions do not depart from the spirit and scope of the appended claims.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically and/or otherwise.

The term "strike face," as used herein, refers to a club head front surface that is configured to strike a golf ball. The term strike face can be used interchangeably with the "face."

The term "geometric centerpoint," as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA). For example, the geometric centerpoint of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term, "at address," as used herein, can refer to a position that a golfer is in when preparing to hit golf shots on or around a putting green.

The term, "address position," as used herein, can refer to a player's body position at address, wherein the player is holding the club such that the head is adjacent the ball as if the player were about to begin a swing.

The term, "short-game" as used herein, can refer to any shots made on or within close proximity to a putting green.

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the ground plane and the loft plane.

The term "lie angle," as used herein, can refer to an angle between a hosel axis, extending through the hosel, and the ground plane. Alternatively, the term "lie angle," as used herein can refer to an angle between a hosel axis and a vertical axis. The lie angle is measured from a front view.

The term "gyroscope," as used herein, can refer to a device or system used for measuring or maintaining orientation and angular velocity.

The term, "accelerometer," as used herein, can refer to a device or system used for measuring vibration, changes in acceleration, or motion of a structure.

I. Physical Assembly

Described herein is a computer-implemented measurement system 100 that determines and assigns a color code 200 aligned with a lie angle 160 of a given golfer at address. The system 100 can generally include at least one processor in operable communication with a gyroscope, accelerometer, and/or similar motion-sensitive technology in a portable electronic device 104 or equivalent measurement tool that determines the position that a golfer holds a short-game golf club 125 at address, as shown in FIG. 1. The system 100 can further include a connection mechanism 110 to attach the portable electronic device 104 to a golf club shaft 130, such as a cradle, strap assembly, clamp, or other suitable connection components.

Golfers, in general, have a wide variety of preferred putting strokes. The variability in address position 230 and preferred putting stroke is due to several factors, which can include a golfer's height, arm length, mobility, and skill level. Due to this, putters are generally optimized to fit a specific golfer's needs. When a putter is properly adjusted to fit a golfer's putting stroke and address position 230, the face angle will generally rest perfectly perpendicular to the ground plane 150, and the lie angle 160 will allow the sole of the putter head to generally rest parallel to the ground plane 150.

Short-game shots, such as putting, chipping, and short-range pitching, require relatively short backswings and, consequently, short follow-throughs. This results in a club position at address that is substantially similar to the club position at impact. As such, the way a golfer holds their club at address indicates the loft and lie angle 160 that golfer will typically strike the ball with for short-game shots. Therefore, the position that a golfer holds the club at address can provide valuable insight towards that golfer's swing characteristics, and in particular, the lie angle 160.

The system 100 described herein can detect a user's lie angle 160 and assign a corresponding color code 200 best suited to a series of clubs adjusted for that lie angle 160. A user's lie angle 160 is determined by several factors, which can include the user's height, limb length, mobility, and skill level. Lie angle 160 directly corresponds with the user's hand position at address, relative to the golf club head. For example, a user who prefers a lower hand position creates a relatively low angle between the golf club shaft 130 and the vertical axis 152. That player would, in general, be better suited for a golf club with a lower lie angle 160 adjustment. By lowering the lie angle 160 of the golf club head in this scenario, the sole of the golf club 125 would remain relatively parallel to the ground plane 150. This relationship between lie angle 160 and hand position would be "flipped" for a user that prefers a higher hand position, wherein the golf club shaft 130 has a more vertical orientation with the ground plane 150.

Loft and lie angle 160 adjustments are commonly used in the golf industry to ensure a player is hitting the ball at optimum positioning for club performance. Short-game clubs in general, such as a putter, will have a low loft and a neutral lie. Short game clubs have a relatively low to zero-degree loft angle 165 adjustment, measured from a standard top shelf to ground plane 150.

Conventional swing aids may require larger or multiple devices to be coupled to the golf club 125 or a human coach to analyze a golfer's swing data. In contrast, via the inventive concept described herein, the user is not in motion when the lie angle 160 is measured by the portable electronic device 104, negating any impact the weight of the device might have on measurements. The user's lie angle 160 during fitting directly reflects the lie angle 160 of that same user during actual play, and the portable electronic device 104 is able to determine and display a (predetermined) color code 200 corresponding to that lie angle 160 for best club fit/calibration. Further, consistent values of the lie angle 160 measurement can be generated for the golfer and transmitted to other devices. Audio, visual, or haptic feedback 235 may be generated or otherwise made available to the golfer by the portable electronic device 104 (or the system application display 112) to indicate when the lie angle 160 has been locked in and when the color code 200 is consequently recommended.

II. Feedback Loop

Figure 11:
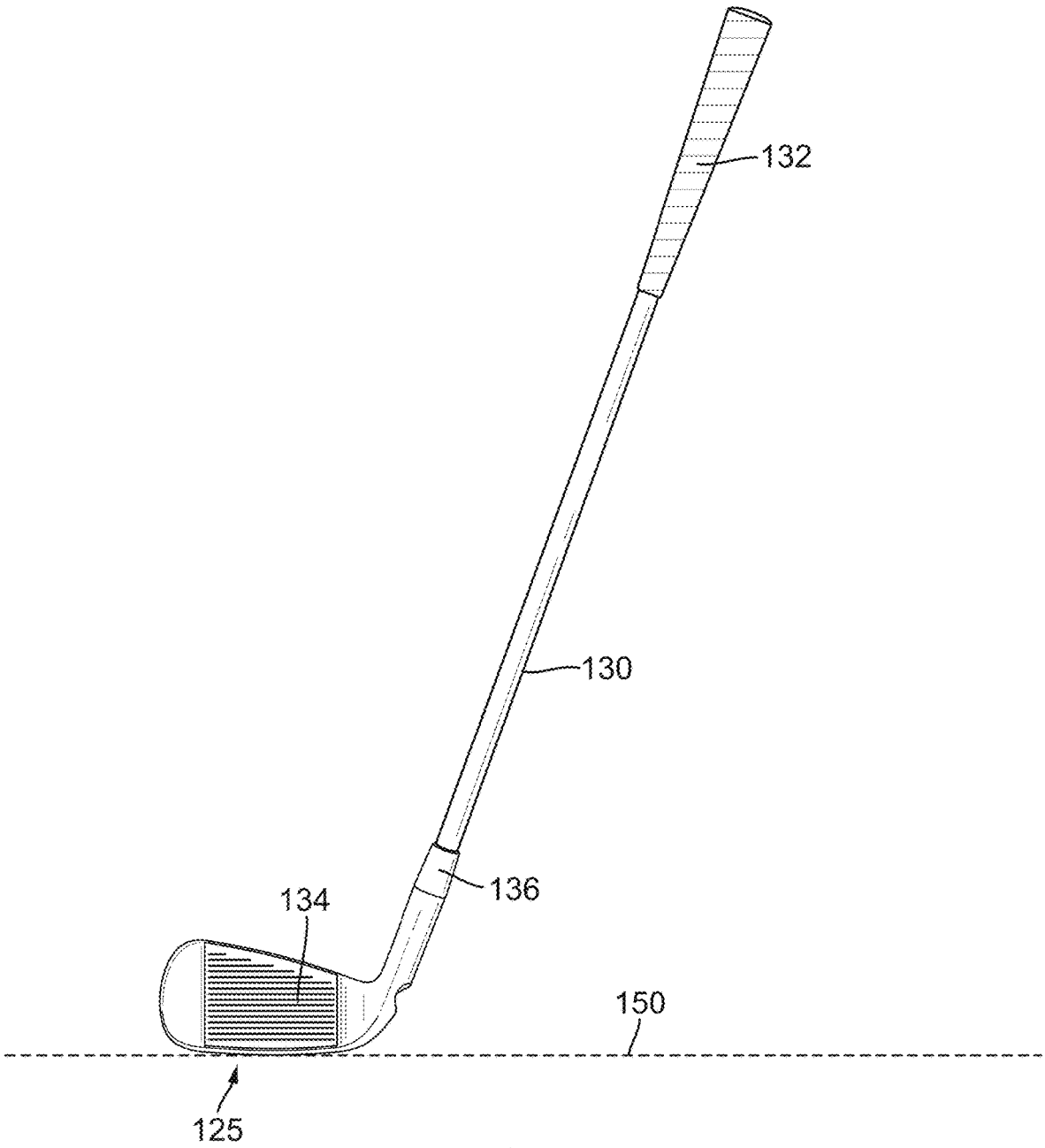
FIG. 11 illustrates a side view of a second embodiment of a portable electronic monitoring device within a shaft of a golf club.
Figure 12:
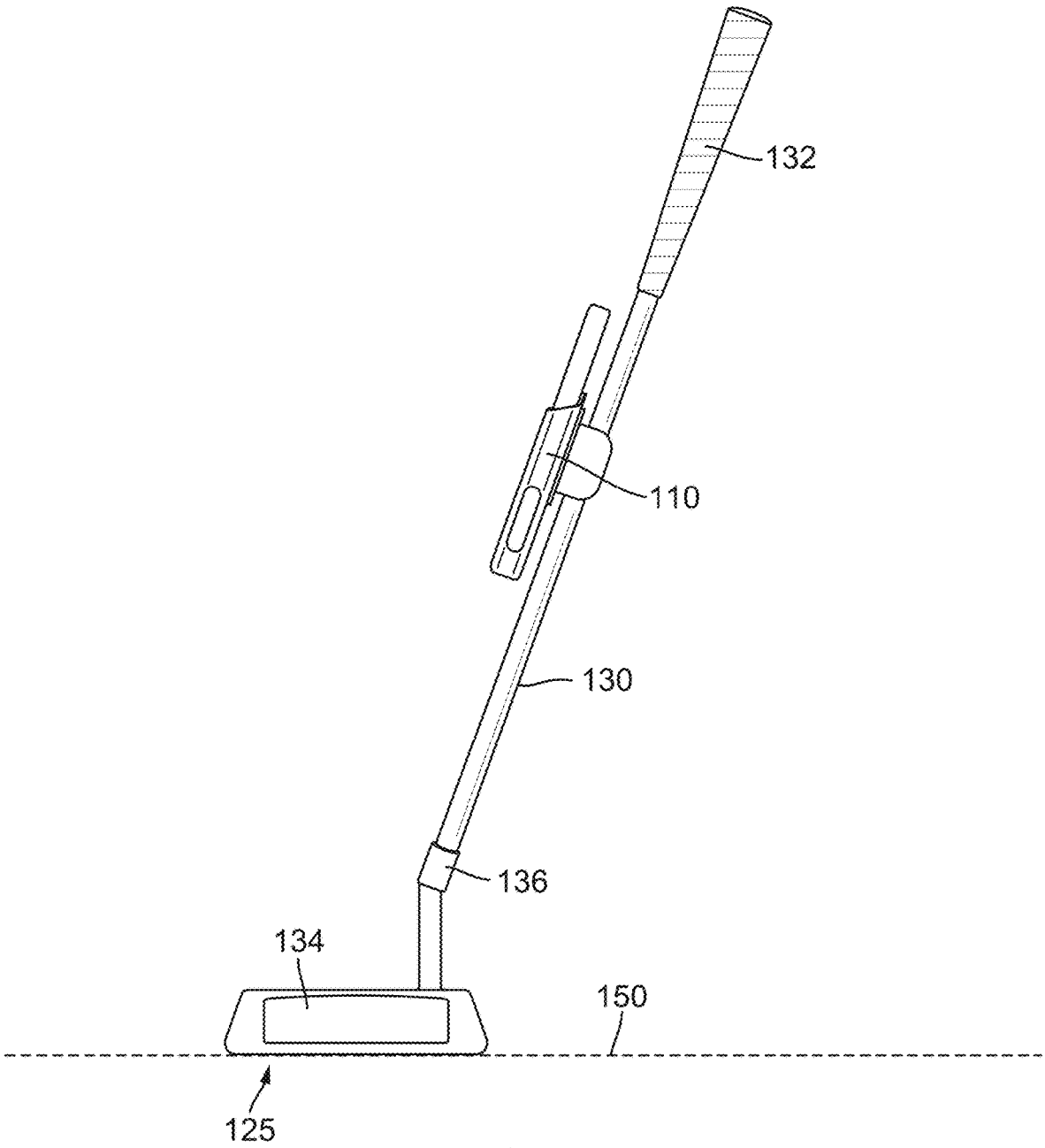
FIG. 12 illustrates a side view of another embodiment of a portable electronic monitoring device connected to a shaft of a golf club.

The system 100 detects the user's lie angle 160 by leveraging the gyroscope and accelerometer, or other suitable sensor means, within the portable electronic device 104, coupled with a series of conditions that (in one example) must be met in order for the system 100 to be "triggered" for measuring and then to "lock in" on a lie angle 160 value. The gyroscope and accelerometer can also be utilized in the physical assembly of the golf club 125, such as, but not limited to, within the shaft 130 or the grip 132, as shown in FIG. 11.

Figure 8:
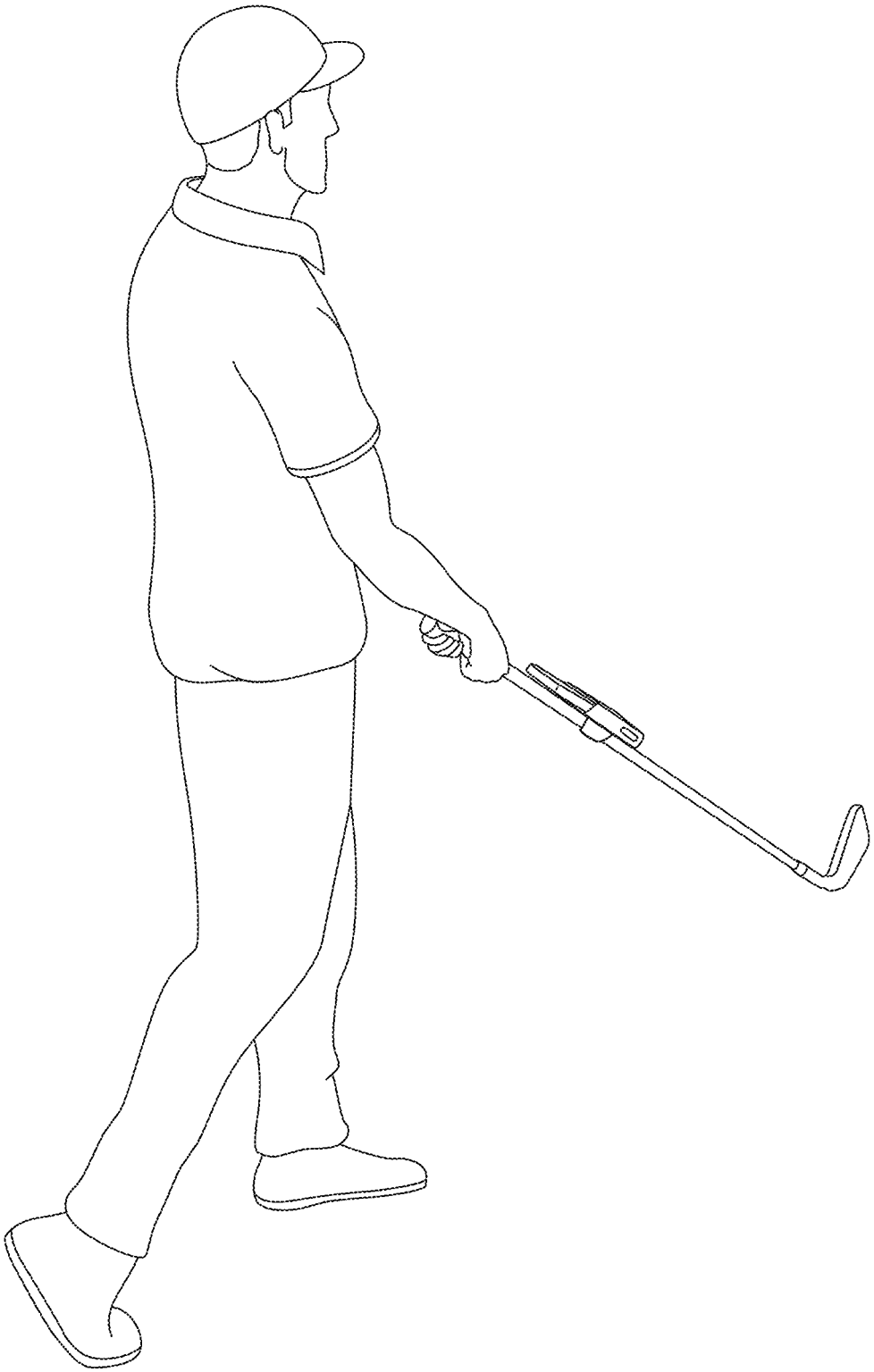
FIG. 8 illustrates a player with the system described herein moving into an address position.
Figure 9:
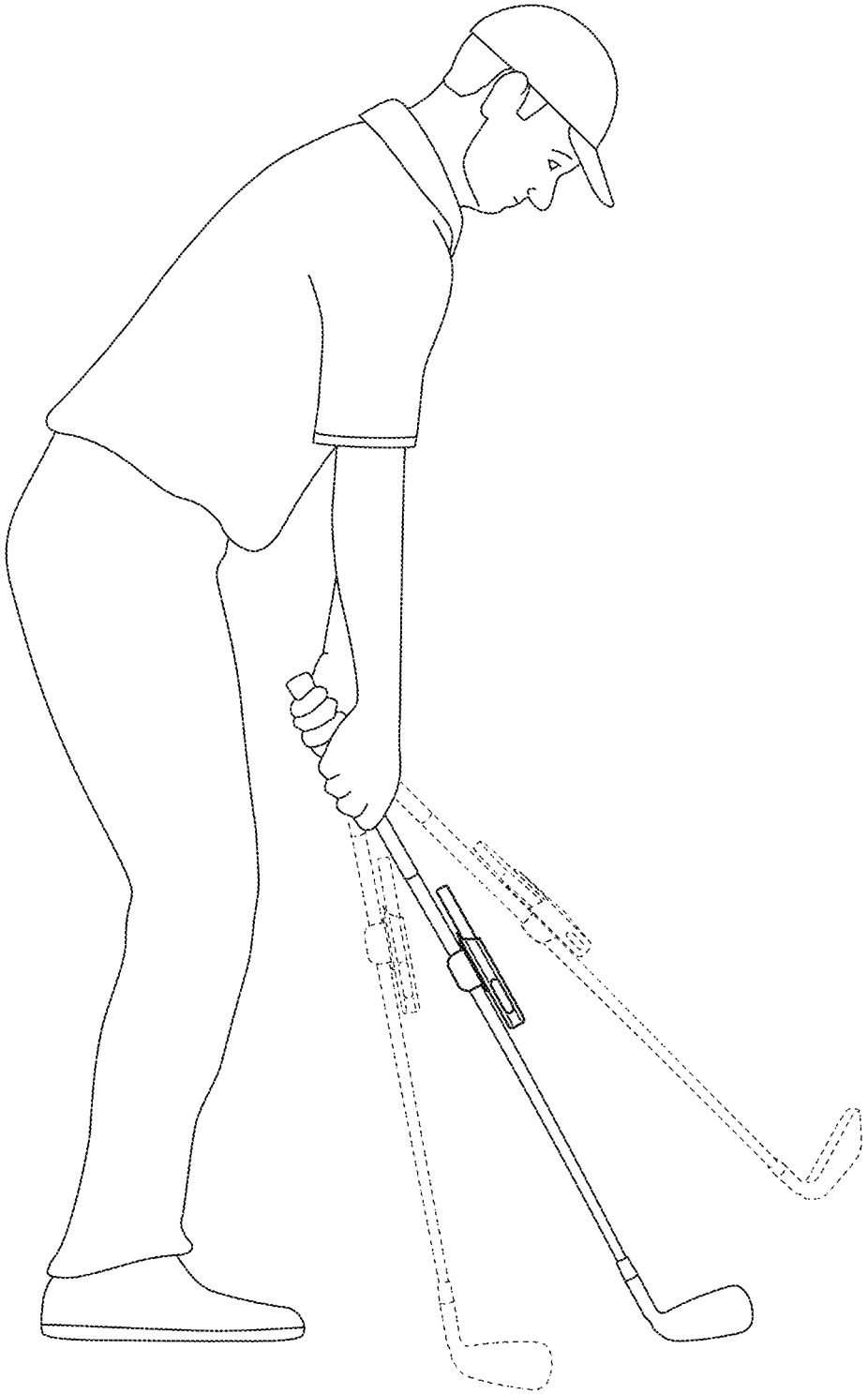
FIG. 9 illustrates the player of FIG. 8 settling their movement to finalize their address position.
Figure 10:
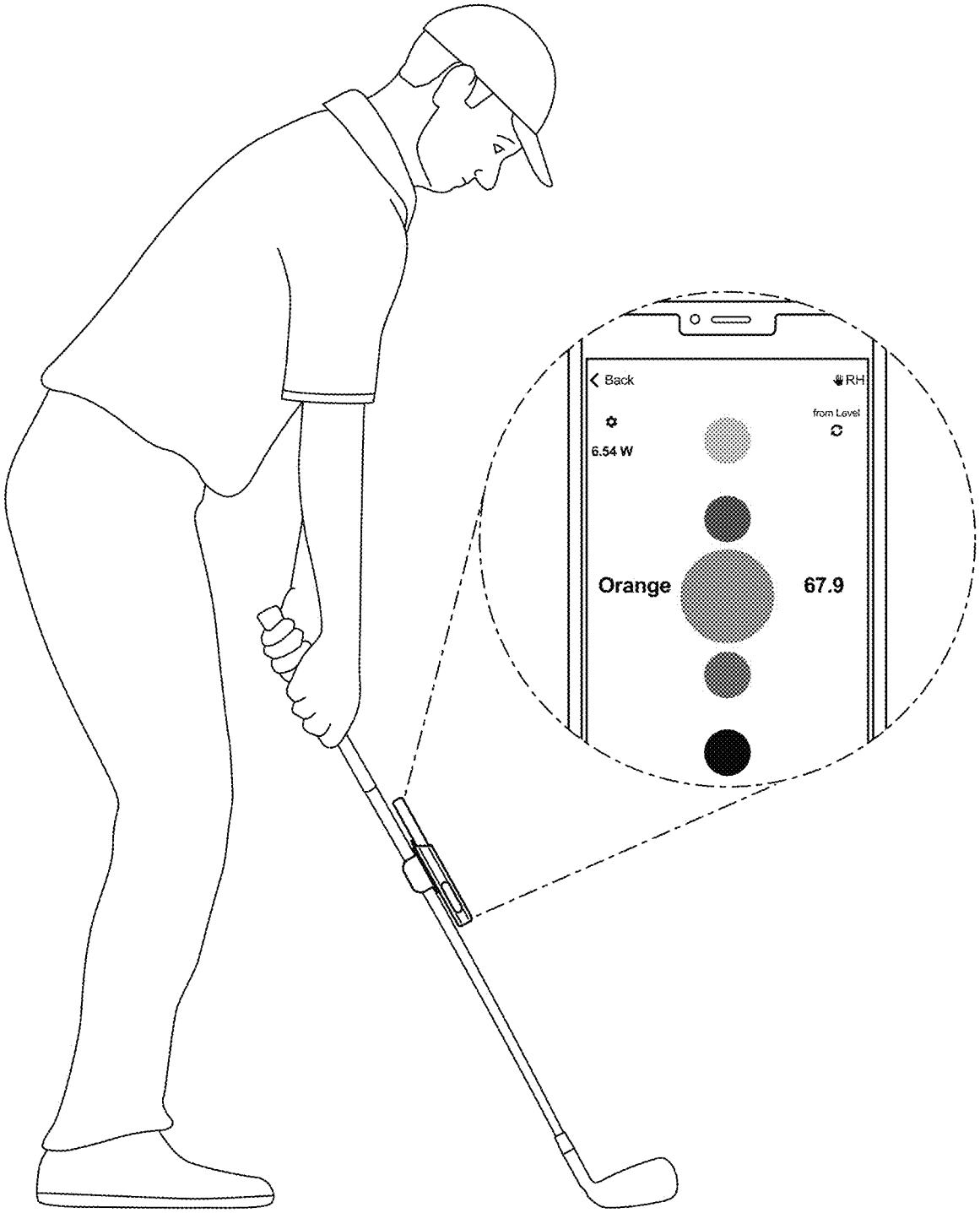
FIG. 10 illustrates the player of FIGS. 8 & 9, in which the system is providing an assigned color code corresponding to the player's recommended lie angle adjustment.

Once the user is in the address position 230 with the portable electronic device 104 attached to or incorporated with their club, as shown in FIG. 8, the accelerometer sends a stream of lie angle 160 values to the processor. The processor then calculates a standard deviation of those lie angle 160 values over an established amount of time. The processor can be configured to access measure changes from the gyroscope in club head orientation within a certain range of sensitivity. The sensitivity of the gyroscope is a value reflecting how still the user is, or a continued period of low movement. Once the user has been still long enough, the standard deviation of lie angle 160 values will drop below a sensitivity threshold established within the predetermined settings 220 fed to the processor. Once the user's detected movement drops below the sensitivity threshold, as shown in FIG. 9, the processor (executing software instructions) is "triggered" and begins a countdown. The lower the sensitivity threshold, the more still the user must be to drop below the sensitivity threshold. With a low sensitivity threshold, the user must maintain a lower deviation in lie angle 160 input to the system 100, i.e., the user must remain more still. The countdown ensures the person remains unmoving for a "triggered" period of time. If the person moves too much in this "triggered" period, the standard deviation of lie angles 160 will go above the sensitivity threshold and the processor will exit the "triggered" period until the standard deviation is below the sensitivity threshold again. If the person remains still and the standard deviation of lie angles 160 remains below the sensitivity threshold for the entire "triggered" period, the processor will "lock-in" on the value of the lie angle 160 at that position. If the person continues to remain still for a "lock-in" period, the processor then saves that value as the user's lie angle 160 at address. The processor as configured translates the measured lie angle 160 into a color code 200 and displays the color code 200 on a system application display 112, as shown in FIG. 10.

The accelerometer records and feeds the processor lie angle 160 values in order for the processor to establish the standard deviation and sensitivity threshold. A stream of lie angle 160 data from the user's position is translated into a standard deviation value. The standard deviation is relative to the level of sensitivity to movement, which can be adjusted in the system 100 settings 220. In particular, the sensitivity can be defined by a coefficient. In some embodiments, the coefficient can be multiplied by 0.1. In many embodiments, the sensitivity value can range between 0.25 and 100. In one embodiment, the sensitivity value ranges inclusively between 1.0 and 2.0. The standard deviation required to move past the "triggered" stage is dependent to the sensitivity in such a way that the standard deviation of lie angle 160 must fall under the upper threshold of sensitivity for movement.

The time required to establish a standard deviation of lie angle 160 can range inclusively between 0.5 and 5 seconds. In many embodiments, the time required to establish a standard deviation can range between 0.5 and 1 seconds, 1 and 2 seconds, 2 and 3 seconds, 3 and 4 seconds, or 4 and 5 seconds. In some embodiments, the time required to establish a standard deviation can be 0.5 seconds, 1 second, 1.5 seconds, 2 seconds, 2.5 seconds, 3 seconds, 3.5 seconds, 4 seconds, 4.5 seconds, or 5 seconds.

The "triggered" period can range inclusively between 0 and 5 seconds. The gyroscope monitors motion under the sensitivity threshold until the "triggered" period is satisfied and the processor moves into the "lock-in" period. In many embodiments, the "triggered" period can range between 0 and 1 seconds, 1 and 2 seconds, 2 and 3 seconds, 3 and 4 seconds, or 4 and 5 seconds. In some embodiments, the "triggered" period can be 0 seconds, 0.5 seconds, 1 second, 1.5 seconds, 2 seconds, 2.5 seconds, 3 seconds, 3.5 seconds, 4 seconds, 4.5 seconds, or 5 seconds.

The "lock-in" period can range inclusively between 0 and 5 seconds. The gyroscope monitors motion under the sensitivity threshold until the "lock-in" period is satisfied and the software records the lie angle 160. In many embodiments, the "lock-in" period can range between 0 and 1 seconds, 1 and 2 seconds, 2 and 3 seconds, 3 and 4 seconds, or 4 and 5 seconds. In some embodiments, the "lock-in" period can be 0 seconds, 0.5 seconds, 1 second, 1.5 seconds, 2 seconds, 2.5 seconds, 3 seconds, 3.5 seconds, 4 seconds, 4.5 seconds, or 5 seconds. The processor will then issue an instruction to display a color code 200 aligned with the user's measured lie angle 160.

III. System Application Display

The fitting system 100 can further comprise an application display 112. The application display 112 can be viewed on the portable electronic device 104, on a screen or device operated by a fitter, or transmitted or otherwise made accessible electronically to be viewed on another device remotely.

Figure 6A:
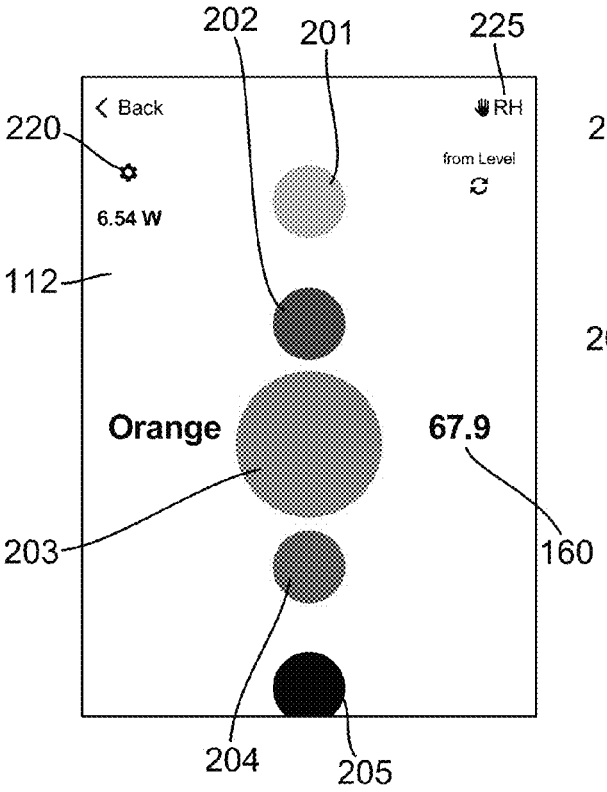
FIG. 6A illustrates a first embodiment of the visual display feedback, in which the assigned color code was orange.
Figure 6B:
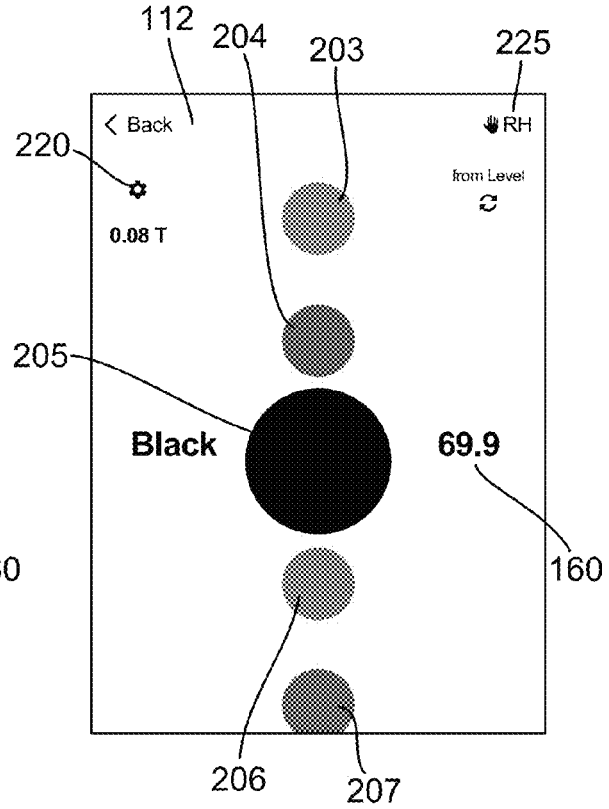
FIG. 6B illustrates a second embodiment of the visual display feedback, in which the assigned color code was black.

The application display 112 can present the color code 200 assigned by the processor executing software instructions. The color code 200 comprises a series of colors corresponding with different club calibrations based on the above described lie angle 160 measurement. Each color code 200 is assigned to one or more clubs calibrated to a particular lie angle 160. As such, the color code 200 displayed at fitting indicates a line of clubs that would be best suited to the user's specific lie angle 160. For example, and as illustrated in FIG. 6A, a person can be fitted through the above-described methods and view on the application display 112 that their measured lie angle 160 was 67.9 degrees and, therefore, their best suited color code 200 is orange 203. This person would then know to look for clubs with an orange color code 200 to know that club is adjusted best for their lie angle 160 of 67.9 degrees. In another example, and as illustrated in FIG. 6B, a person can be fitted through the above-described methods and view on the application display 112 that their measured lie angle 160 was 69.9 degrees and, therefore, their best suited color code 200 is black 205. This person would then know to look for clubs with the color code 200 black 205 to know that club is adjusted best for their lie angle 160 of 69.9 degrees. The application display 112 further shows adjacent color codes 200 that decrease in proximity to the user's measured lie angle 160 in either direction. The user can then use the displayed information to choose a club with that color code 200 and thereby receive a club calibrated to that player's specific lie angle 160 characteristics.

In many embodiments, the system recommends one or more clubs with the measured lie angle. The player can use this recommendation to order or purchase a club with a lie angle best suited to their fitted configurations. The recommendation can be displayed on the portable electronic device or used in communication with an online account associated with that player.

TABLE I

Exemplary Example of a Color Code Series Corresponding Lie Angle

| Color Code | Lie Angle - from hosel axis to horizontal axis/ground plane (degrees) | Lie Angle - from hosel axis to vertical axis (degrees) |
|---|---|---|
| Gold | 65.5-66.4 | 24.5-23.6 |
| Brown | 66.5-67.4 | 23.5-22.6 |
| Orange | 67.5-68.4 | 22.5-21.6 |
| Red | 68.5-69.4 | 21.5-20.6 |
| Black | 69.5-70.4 | 20.5-19.6 |
| Blue | 70.5-71.4 | 19.5-18.6 |
| Green | 71.5-72.4 | 18.5-17.6 |
| White | 72.5-73.4 | 17.5-16.6 |
| Silver | 73.5-74.4 | 16.5-15.6 |
| Maroon | 74.5-75.5 | 15.5-14.5 |

As shown in the table above, the lie angle 160 can be measured from the hosel axis 154 to the horizontal axis/ground plane 150 or from the hosel axis 154 to the vertical axis 152. The above colors indicate an exemplary example of a color code 200 and the corresponding lie angle 160 values, however, other colors or assigned lie angle 160 values can be employed.

In many embodiments, the application display 112 can be interactive. The application display 112 can comprise options that allow the user or fitter to further specify characteristics of the player being fitted that may improve the fitting accuracy of the system 100. For example, the application display 112 can allow the user or fitter to specify that the player is left or right-handed. In some embodiments, the application display 112 can allow the user or fitter to select specific player characteristics such as player height, grip type, preferred proximity to the ball, or other relevant short-game play factors.

Once the system 100 has determined the user's proper lie angle 160, the user may correctly select golf clubs that correspond to the system's 100 output. For example, if the system 100 determines a user's color code 200 to be orange 203, the user can select a set of golf clubs that coincide with the orange color code 200, having a lie angle 200 between 67.5-68.4 degrees (measured from hosel axis to ground plane 150).

IV. Benefits

The system 100 described herein could optimize short-game shots for players by ensuring that the lie angle 160 assigned to them by virtue of the measuring components corresponds to a series of golf clubs that will rest horizontally parallel to the ground. Thus, players could increase their performance on short-game shots by more reliably striking the golf ball with the center of the strike face 134, reducing off-center strikes that could result in a ball trajectory in a direction different than the intended direction.

The system 100 described herein could drastically reduce error in lie angle 160 measurement by removing human error and unreliable methodology from the process. The system 100 can automatically analyze and assign a color code 200 to each player, specifically, and generate a predetermined list of golf clubs 125 that complement the measured lie angle 160 without subjective interpretation by either the player or a golf club fitting specialist. By relying solely on the gyroscope, accelerometer, and/or other suitable sensor components from portable electronic devices 104, accurate club recommendations could be more achievable than club recommendations made in reliance upon traditional methodology.

The system 100 described herein could drastically reduce the time involved in lie angle 160 measurement. As opposed to traditional methods, which involve analysis of still-images or physical measurement, the system 100 described herein can simply attach a portable electronic device 104 to a golf club shaft 130, begin analysis, and lock-in on a lie angle 160 at address in a matter of seconds, potentially reducing the overall time of lie angle 160 detection.

The system 100 described herein could improve the availability of accurate lie angle 160 measurement for players. Portable electronic devices 104 are readily accessible and available, thus, by downloading the software application, anyone could have access to a lie angle 160 measuring tool that can allow players, personally, or golf club fitting specialists to have better insight into golf clubs 125 that might better suit their lie angle 160 at address.

The system 100 described herein could be useful to use in combination with dynamic motion sensor devices to allow for a more wholistic interpretation of player-specific golf swing characteristics, potentially increasing the likelihood that final golf club fitting recommendations more accurately suit a player for any golf club 125 type.

Many players within the sport of golf utilize online accounts in order to store information pertaining to their own measurements, scores, owned clubs, etc. The system described herein can communicate online with digital accounts such as these to provide direct access to the software's recommended lie angle. Thus, the player can refer directly to the stored memory of the system and the account for lie angle guidance when choosing a club from the recommended selection.

V. Example 1

The static position of the club head was measured in comparison to the dynamic position at impact. This comparison was used to determine the accuracy of the system 100 static measurement described herein with the actual impact angle of a swing. Such a comparison reflects how the static measurement system 100 and color code 200 recommendation described above compares to dynamic measurements provided through traditional methods.

TABLE II

Loft Angle Measurements Taken Using System and Launch Monitor

| Trail No. | Measured Lie Angle from System (°) | Measured Lie Angle from Launch Monitor (°) | Difference in Measured Lie Angle | Percent Error (%) |
|---|---|---|---|---|
| 1 | 27.92 | 27.84 | 0.08 | −0.28736 |
| 2 | 25.02 | 25.99 | −0.97 | 3.732205 |
| 3 | 23.62 | 28.42 | −4.8 | 16.88951 |
| 4 | 30.38 | 30.42 | −0.04 | 0.131492 |
| 5 | 24.78 | 25.44 | −0.66 | 2.59434 |
| 6 | 23.66 | 24.98 | −1.32 | 5.284227 |
| 7 | 25.22 | 28.04 | −2.82 | 10.05706 |
| 8 | 23.34 | 22.94 | 0.4 | −1.74368 |
| 9 | 22.82 | 23.8 | −0.98 | 4.117647 |
| 10 | 18.54 | 21.76 | −3.22 | 14.79779 |
| 11 | 24.18 | 23.54 | 0.64 | −2.71878 |
| 12 | 16.26 | 19.1 | −2.84 | 14.86911 |
| 13 | 23.08 | 22.32 | 0.76 | −3.40502 |
| 14 | 20.8 | 24.52 | −3.72 | 15.17129 |
| 15 | 30.44 | 30.1 | 0.34 | −1.12957 |
| 16 | 23.26 | 22.1 | 1.16 | −5.24887 |
| 17 | 29.72 | 29.64 | 0.08 | −0.26991 |
| 18 | 21.26 | 24 | −2.74 | 11.41667 |
| 19 | 23.92 | 26.82 | −2.9 | 10.81283 |
| 20 | 27.98 | 26.08 | 1.9 | −7.28528 |
| 21 | 18.34 | 22.1 | −3.76 | 17.01357 |
| 22 | 21.1 | 25.82 | −4.72 | 18.2804 |
| 23 | 23.96 | 21.98 | 1.98 | −9.00819 |
| 24 | 21.64 | 22.22 | −0.58 | 2.610261 |
| 25 | 29.56 | 26.2 | 3.36 | −12.8244 |
| 26 | 31.6 | 32.3 | −0.7 | 2.167183 |

Table II illustrates comparative results related to lie angle 160 measurements taken using a launch monitor and the described system 100. In this example, lie angle 160 is measured from the vertical axis 152. For the purpose of this test, results from the launch monitor are considered the control. The launch monitor recorded dynamic lie angle 160 values at impact. These dynamic results show the player's lie angle 160 during a golf swing. Over the course of the test, 26 trials were completed. During each trial, a user would perform a short-range chip shot where the system 100 and the launch monitor would measure the user's lie angle 160. The results show that, on average, the system's 100 lie angle 160 results differ from that of the launch monitor by roughly 1 degree or an average error of 4.0%. The relatively low discrepancy between the static lie angle 160 measurement with the described system 100 and the dynamically measured lie angle 160 of the launch monitor indicates an effective predictive model. Specifically, the low error indicates the system 100 can accurately predict dynamic the proper lie angle 160 characteristics of a given golfer.

VI. Example 2

A player utilized the above described system to receive a personalized color code corresponding to a golf club best fitted to that player. A mobile device comprising an accelerometer and gyroscope was placed into a cradle and the cradle was then placed onto the shaft of a club. The player held the club as they typically would during play and moved into the address position. The player then held their position until the threshold for movement was established by the software and the software locked in on the player's position. The software then provided haptic feedback in the form of an auditory noise.

Once the system determined the player's average threshold of movement, the mobile device produced a beeping sound that implied a countdown. The beeping sound continued until the player had maintained their position for a period of time. In this example, the settings were such that the player needed to maintain their position for three seconds. Each second was marked by a beep, and after three seconds, a different audio feedback was provided by the system to indicate a locked measurement. The screen of the mobile device then displayed a color code corresponding to clubs with the recommended lie angle for that player. That player received one of said clubs comprising a color code well suited to the player's form.

Figure 7:
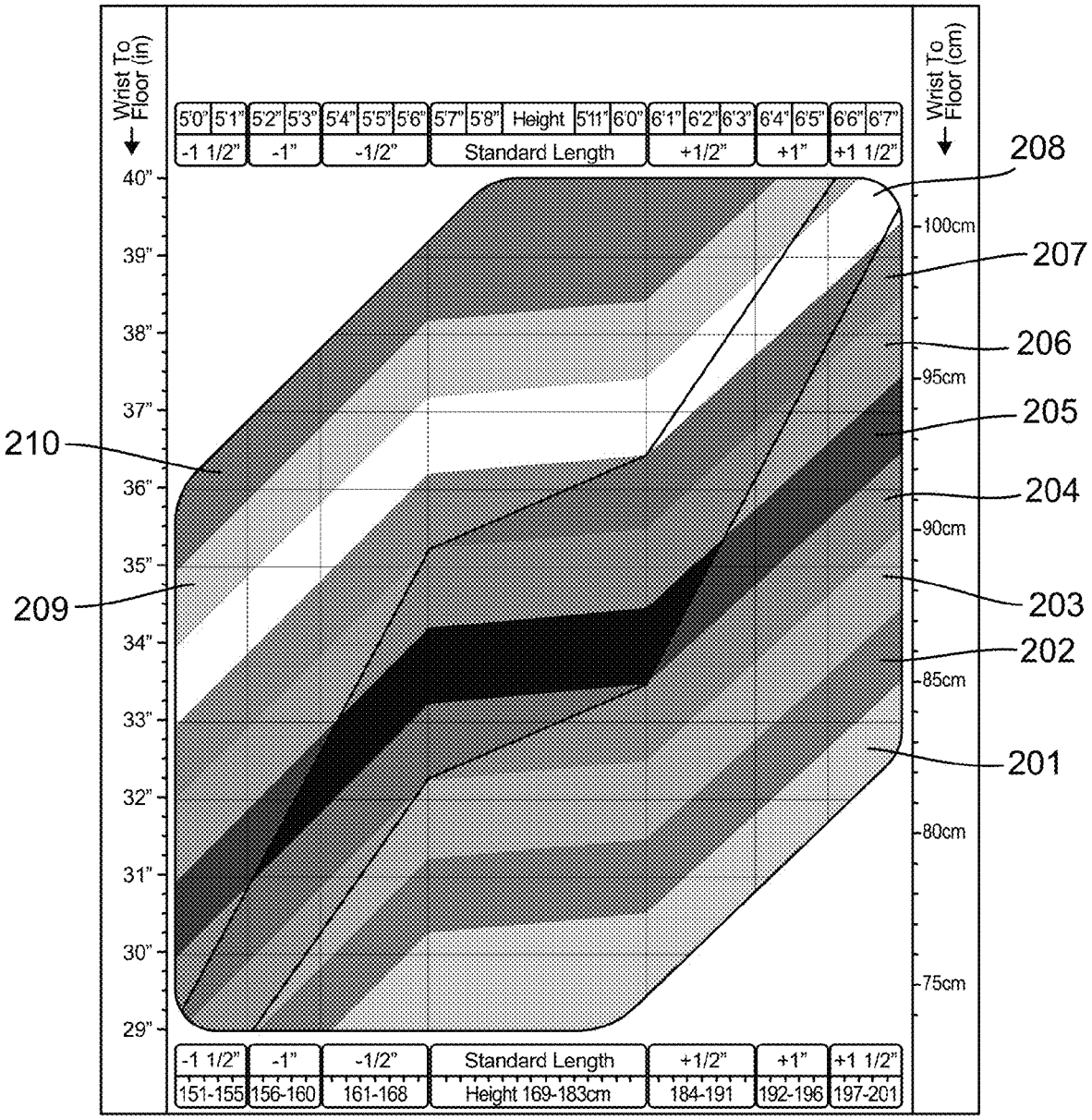
FIG. 7 illustrates a color code chart associated with lie measurement considerations.

This particular player was 5'10" with a wrist-to-floor length of 35". As illustrated in FIG. 7, this measurement would typically have placed them in the "blue" color code. This means the player was fitted for a suitable, well-fitted club lie angle and length without the need to physically measure the height and wrist-to-floor length of that player. Additionally, the player's particular style of holding the club with reference to their grip and address position were considered in the calculation. Therefore, the system described herein was able to recommend a color code specific to that player and best suited to that player's personal way of playing.

This player in particular had been fitted professionally for a recommended lie angle in the past. The prior fitting utilized conventional cameras and laser sensors to determine the best lie angle for that player's form and physical specifications. In that fitting, the player was recommended a lie angle of 70.9, measured from hosel axis to ground plane. This prior lie angle aligns with the color code recommended by the system, thus illustrating the player was able to receive an accurate lie angle fitting by utilizing the system described herein.

CLAUSES

Clause 1: A system, comprising: a plurality of sensor components configured for generating measurements along a golf club, the plurality of sensor components including a gyroscope and an accelerometer; and a processor in operable communication with a memory including instructions defining a process executable by the processor, the process, when executed, being operable to: issue an indication for a user to line up the golf club at address, access data associated with the measurements from the plurality of sensor components related to motion of a head of the golf club at the address, and determine a lie angle by locking in an angle value based on a feedback loop of low-detected motion, the lie angle corresponding to a color code, the color code being predetermined to be associated with one or more golf clubs calibrated to the lie angle.

Clause 2: The system of clause 1, wherein the plurality of sensor components is housed onboard a portable electric device, the portable electric device configured to mount along a shaft of the golf club for generating the measurements.

Clause 3: The system of clause 1, wherein the plurality of sensor components is integrated within a shaft of the golf club.

Clause 4: The system of clause 1, wherein the processor further issues an instruction to display the color code along a display to prompt the user to seek the one or more golf clubs labeled with a same color code.

Clause 5: The system of clause 1, wherein the processor further issues an instruction to provide feedback to the user that the lie angle is locked in during determination of the lie angle.

Clause 6: The system of clause 5, wherein the feedback is auditory.

Clause 7: The system of clause 1, wherein the feedback is haptic.

Clause 8: The system of clause 1, wherein the plurality of sensor components is housed within a portable electronic device, and the portable electronic device is configured to store the color code in online communication with a player's digital account.

Clause 9: The system of clause 1, wherein the golf club is a short-game club.

Clause 10: A method of measuring a golfer's form and recommending a suitable golf club, comprising: (i) indicating for the golfer to move into an address position while holding a golf club with a portable electronic device attached, wherein the portable electronic device comprises a plurality of motion sensors in communication with a processor; the processor is in communication with an operable memory; (ii) assessing, by the plurality of motion sensors, an average threshold of movement for that player in the address position; (iii) determining a locked in position relative to a lie angle of the golf club by means of a low-motion feedback loop; (iv) generating, by the processor, a lie angle metric from the golfer's locked in position; wherein the lie angle metric corresponds to a color code, and; wherein the color code corresponds to one or more golf clubs calibrated to that lie angle.

Clause 11: The method of clause 10, wherein the portable electronic device comprises an accelerometer and gyroscope.

Clause 12: The method of clause 10, further comprising issuing instructions, by the processor, to the portable electronic device to provide feedback to the golfer when the locked in position is determined.

Clause 13: The method of clause 12, wherein the feedback is auditory.

Clause 14: The method of clause 12, wherein the feedback is haptic.

Clause 15: The method of clause 10, wherein the portable electronic device comprises a display, and issuing instructions, by the processor, to display the color code on the display.

Clause 16: The method of clause 10, further comprising issuing instructions, by the processor, on the display to prompt the user to seek the one or more golf clubs labeled with a same color code.

Clause 17: The method of clause 10, wherein the golf club is a short-game club.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A system for detecting and characterizing a position of a golf club, comprising:

a golf club having a shaft;

a connection mechanism coupled to the shaft and configured to hold a portable electronic device, the portable electronic device comprising:

an application display;

a plurality of sensor components including a gyroscope and an accelerometer; and a processor in operable communication with a memory including instructions defining a process executable by the processor, the process, when executed, being operable to:

issue an indication for a user to line up the golf club in an address position;

continuously compute a stream of lie angles based on actual lie angle data from the accelerometer as the user holds the golf club;

dynamically calculate a standard deviation of the stream of lie angles;

calibrate the gyroscope to detect movement of the golf club;

numerically define a sensitivity threshold, corresponding to an upper limit of the standard deviation of the stream of lie angles that indicates when the golf club is in the address position;

trigger a first countdown, once the standard deviation of the stream of lie angles drops below the sensitivity threshold;

activate a lock-in period, after the first countdown expires without the standard deviation of the stream of lie angles exceeding the sensitivity threshold;

wherein the accelerometer measures a locked-in lie angle after the lock-in period expires; and wherein the locked-in lie angle corresponds to a color code, the color code being predetermined to be associated with one or more suggested golf clubs approximately calibrated to the locked-in lie angle.

2. The system of claim 1, wherein the processor further issues an instruction to show the color code on the application display.

3. The system of claim 1, wherein the processor further issues an instruction to provide feedback to the user after the locked-in lie angle is measured.

4. The system of claim 3, wherein the feedback is auditory.

5. The system of claim 3, wherein the feedback is haptic.

6. The system of claim 1, wherein the portable electronic device is configured to store the color code in online communication with a digital account associated with the user.

7. The system of claim 1, wherein the golf club is a short-game club.

8. A method of determining a recommended golf club having a suitable lie angle, comprising:

(i) indicating, on an application display of a portable electronic device, for a user to move into an address position while holding a golf club;

wherein the portable electronic device is attached to a shaft of the golf club;

wherein the portable electronic device comprises a plurality of motion sensors in communication with a processor;

wherein the processor is in communication with an operable memory; and wherein the plurality of motion sensors includes an accelerometer and a gyroscope;

(ii) continuously computing a stream of lie angles based on actual lie angle data from the accelerometer;

(iii) dynamically calculating a standard deviation of the stream of lie angles;

(iv) triggering a first countdown once the standard deviation of the stream of lie angles is below a predetermined sensitivity threshold;

(v) activating a lock-in period, only if the first countdown expires without the standard deviation of the stream of lie angles exceeding the predetermined sensitivity threshold;

(vi) measuring, after the lock-in period expires, a locked-in lie angle of the golf club at the address position;

wherein the locked-in lie angle corresponds to a color code; and wherein the color code corresponds to one or more suggested golf clubs approximately calibrated to the locked-in lie angle.

9. The method of claim 8, further providing feedback when the locked-in lie angle is determined.

10. The method of claim 9, wherein the feedback is auditory.

11. The method of claim 9, wherein the feedback is haptic.

12. The method of claim 8, further showing the color code on the application display.

13. The method of claim 8, further comprising issuing instructions on the application display to prompt the user to seek the one or more suggested golf clubs labeled with the color code.

14. The method of claim 8, wherein the golf club is a short-game club.

* * * * *